United States Patent [19]

Yamanaka et al.

[11] 4,327,469

[45] May 4, 1982

[54] METHOD FOR MOUNTING RING-SHAPED CONSTRUCTION ON SHIP STERN

[75] Inventors: Koichi Yamanaka, Wakayama; Ryuzo Yamasaki, Yachiyo; Yoshiharu Sakai; Takashi Hirono, both of Wakayama, all of Japan

[73] Assignee: Mitsui Engineering and Shipbuilding Co., Ltd., Tokyo, Japan

[21] Appl. No.: 128,964

[22] Filed: Mar. 10, 1980

[51] Int. Cl.[3] ..... B23Q 3/00

[52] U.S. Cl. ..... 29/407; 29/464; 29/468

[58] Field of Search ..... 29/406, 407, 418, 464, 29/468; 415/182; 440/47, 67

[56] References Cited

U.S. PATENT DOCUMENTS

| | | | |
|---|---|---|---|
| 2,705,375 | 4/1955 | Foreman et al. | 29/407 |
| 3,066,893 | 12/1962 | Mercier | 244/73 R |
| 3,179,081 | 4/1965 | Backhaus et al. | 440/5 |
| 3,455,268 | 7/1969 | Gordon | 440/67 X |
| 3,605,672 | 9/1971 | Strumbos | 414/166 |
| 3,635,186 | 1/1972 | German | 440/67 X |
| 4,205,424 | 6/1980 | Nagao et al. | 29/407 |

FOREIGN PATENT DOCUMENTS

| | | | |
|---|---|---|---|
| 490526 | 1/1930 | Fed. Rep. of Germany . | |
| 651579 | 10/1937 | Fed. Rep. of Germany . | |
| 160588 | 8/1941 | Fed. Rep. of Germany . | |
| 722842 | 7/1942 | Fed. Rep. of Germany . | |
| 1181090 | 11/1964 | Fed. Rep. of Germany | 440/67 |
| 894007 | 12/1944 | France . | |
| 1397310 | 3/1965 | France . | |
| 378542 | 2/1940 | Italy . | |
| 51-111698 | 9/1976 | Japan . | |
| 51-111699 | 9/1976 | Japan . | |
| 54-3797 | 1/1979 | Japan | 440/67 |
| 401425 | 11/1933 | United Kingdom . | |
| 1231147 | 5/1971 | United Kingdom . | |
| 1455184 | 11/1976 | United Kingdom . | |
| 1501637 | 2/1978 | United Kingdom . | |
| 1561505 | 2/1980 | United Kingdom . | |
| 1561506 | 2/1980 | United Kingdom . | |

*Primary Examiner*—Ervin M. Combs
*Attorney, Agent, or Firm*—Armstrong, Nikaido, Marmelstein & Kubovcik

[57] ABSTRACT

A method for mounting a ring-shaped construction on a ship stern in front of a propeller which comprises fixing a plurality of pieces at a predetermined distance along a periphery of a ring-shaped construction, marking the points respectively on a plurality of said pieces which are located in a same distance from the center of said ring-shaped construction, and mounting said ring-shaped construction to said ship stern. In this process, centering so that the circular locus of the beam emitted from a projector being rotated around the rotating axis of a propeller passes over said marked points of a plurality of pieces fixed to said ring-shaped construction, the settling position of said ring-shaped construction is adjusted.

7 Claims, 16 Drawing Figures

METHOD FOR MOUNTING RING-SHAPED CONSTRUCTION ON SHIP STERN

BACKGROUND OF THE INVENTION

The present invention relates to a method for mounting a ring-shaped construction on a ship stern, particularly a method for mounting precisely and easily on a ship stern in front of a propeller.

In recent years, in order to get the higher economical efficiency of a ship, the building cost has been reduced by adopting a full hull form as far as possible for the required dead weight. However, the fullness of hull form increases a turbulent flow and an inequality of flow field especially in the vicinity of the ship stern. As the result, these phenomena cause not only an increase of fluid resistance and a decrease of propulsive efficiency, but also increases of propeller cavitation, hull vibration and noise etc.

It has been found experimentally that the turbulent flow and the inequality of flow field around the propeller can be reduced by providing a ring-shaped construction which is equipped on the ship stern in front of the propeller, being not overlapped with said propeller by the detailed investigation of flow field in the vicinity of the ship stern aforementioned, resulting the reductions of necessary horse power, propeller cavitation, vibration and noise.

Said ring-shaped construction is mounted directly to the ship stern and/or through supporting members. In this case, it is important that the ring-shaped construction is mounted precisely on the ship stern.

If the accuracy of the mounting is low, the effect of said ring-shaped construction is decreased. But the ring-shaped construction is generally large in size, for instance in case of a hull of about 250,000 tons tanker, the ring-shaped construction has the following dimensions: inner diameter of about 900 cm, width of about 450 cm, and weight of about 90 tons.

It is a very difficult work to mount such a large scale ring-shaped construction precisely on the ship stern without accompanying a large amount of error.

OBJECTS OF THE INVENTION

An object of the present invention is to provide a method for mounting a ring-shaped construction precisely on a ship stern.

Another object of the present invention is to provide a method for mounting precisely and easily the ring-shaped construction on the ship stern with a simple centering operation.

Further objects of the invention will be clarified with the following detailed explanation and accompanying drawings.

BRIEF SUMMARY OF THE INVENTION

In accordance with the present invention, the foregoing and other objects can be attained by a method for mounting a ring-shaped construction on a ship stern which comprises providing a ring-shaped construction, fixing a plurality of pieces arranged at a predetermined distance along a periphery of said ring-shaped construction, points being marked on said plurality of pieces which are located in a same distance from the center of said ring-shaped construction before or after fixing said pieces, marking lines on which said ring-shaped construction is to be mounted on said ship stern, providing a projector which can be rotated with the basis of revolution center of said propeller, and mounting to fix said ring-shaped construction on said ship stern, wherein the position of said ring-shaped construction is adjusted by rotating said projector and centering to coincide the circular locus of the beam of said projector with marking points on said pieces.

DETAILED DESCRIPTION OF THE INVENTION

Figure 1:
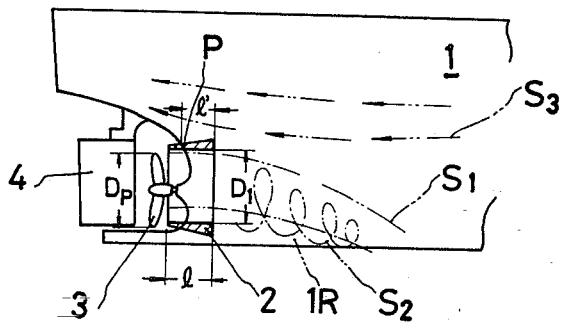
FIG. 1 is a brief side view of a ship being mounted a ring-shaped construction on a ship stern.

In FIG. 1, the number 1 means a hull and a ring-shaped construction 2 is mounted on a ship stern 1R being arranged in front of a propeller 3. The number 4 means a rudder.

As shown in FIG. 1, when the ring-shaped construction 2 is mounted in a manner such that the leading edge thereof lies within a range of turbulency in the flow field, the flow $S_1$ accompanied by 3-dimensional separation vortices $S_2$ directed upward, forwardly of the ring-shaped construction 2, can be regulated and homogenized into parallel flows. Moreover, the flow $S_3$ above the ring-shaped construction 2 can be separated substantially from the flow $S_1$ rolled up from below due to the presence of the construction 2, so that the turbulence can be suppressed. In consequence, this ring-shaped construction 2 reduces the hull resistance and serves as a flow regulator for the fluid flowing into the propeller 3, and supplies flows which cause the propeller 3 to produce a sufficient thrust.

Relating to the mounting position of the ring-shaped construction, if the ring-shaped construction 2 is disposed too much forward of the propeller 3, particularly if it is forwardly distant from the propeller at a value more than 3 times the propeller diameter $D_p$, since the boundary layer at that position is thin (the thickness of the slow current portion of the fluid flowing along the hull is thin,) an effective utilization of the wake is hardly realized, and if the leading edge of the ring-shaped construction 2 lies too close to the propeller 3 away from the stern frame, where the wake is in a condition of being diffused, an effective guiding of the wake into the operative plane of the propeller 3 becomes difficult.

Further, if the length l of the ring-shaped construction 2 is too short, there can be no effect realized of suppressing turbulence in the stern flow field and effectively guiding the flow; on the contrary, if it is too long, the resistance of this appendage itself becomes large. Taking these various facts into consideration, the length l of the ring-shaped construction 2 should effectively be within a range of from about 20% to about 100% of the propeller diameter $D_p$.

At the portion where the upper end face of the ring-shaped construction 2 is directly joined to the hull, the distance from the rearmost joining point (in FIG. 1, the intersecting point P of the upper end face of the ring-shaped construction 2 and the stern frame) to the foremost end of the ring-shaped construction 2, namely the length l' of the portion over which the construction 2 is directly joined to the hull has to be more than 20% of the length l of the ring-shaped construction 2 in order to there attain a suppression of flow turbulence, and homogenization of flows and effective utilization of the wake as described above.

There is an intimate relationship present between the inner diameter $D_l$ of the ring-shaped construction 2 and the propeller diameter $D_p$.

As shown in FIG. 1, in the inner face of the trailing edge of the ring-shaped construction 2 at the height of the propeller shaft, the diameter $D_l$ is about 60% to about 150% of the propeller diameter $D_p$.

When $D_l$ is too large, the slow flow guided toward the propeller 3 by means of the ring-shaped construction 2 cannot be effectively sent into the propeller operative plane, resulting in large loss of energy outside the propeller disc area, and on the contrary, when $D_l$ is too small, the rate becomes greater at which the relatively fast flow outside the ring-shaped construction 2 gets in the operative plane of the propeller 3, whereby the propulsive efficiency becomes lowered, and accordingly it is necessary to determine the diameter $D_l$ of the ring-shaped construction 2 in consideration of the example of comparative experiments relating to a distribution of flow velocity flowing into the propeller of the ship.

The cross-sectional shape of the ring-shaped construction 2 is also important. It resembles the wing shape in general. However, since it is necessary to outwardly widen slow flows near the ship stern and supply the flow uniformly within the operative plane of the propeller 3, the cross-sectional shape of the ring-shaped construction 2 should differ from that of prior art stern fins.

Namely, the ring-shaped construction has a cross-section having a convex face inside and a flat face outside. Also, the angle of said flat face of the cross-section shape relative to the center line of the hull should suitably be in a range of approximately from −10 degrees to 30 degrees.

Figure 2:
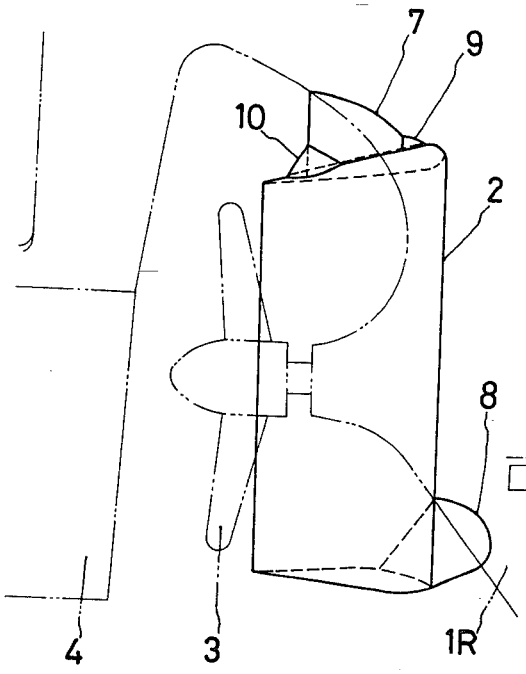
FIG. 2 is a side view, partially in section, of the ring-shaped construction in a condition just after mounted on the ship stern according to the present invention.
Figure 3:
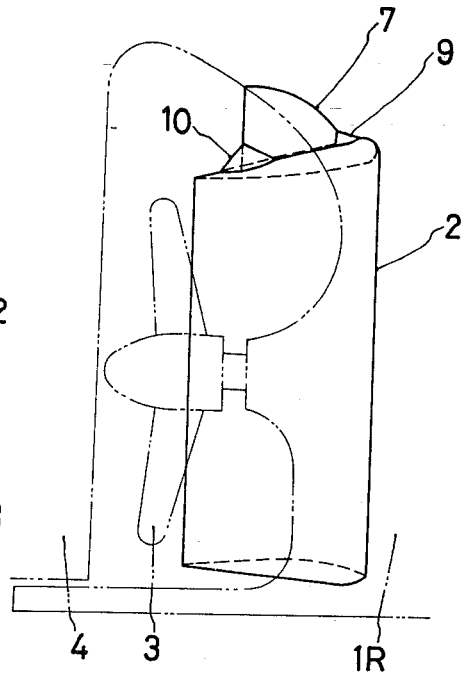
FIG. 3 is a side view of another embodiment of the ring-shaped construction in a condition just after mounted on the ship stern according to the present invention.

FIGS. 2 and 3 show the conditions in which said ring-shaped construction are mounted on the ship stern respectively, for an open stern in the former case and for a closed stern in the latter case.

The ring-shaped construction is provided with a notched portion at its upper end, which is welded after fitting on the ship stern 1R.

Furthermore, the upper end portion is welded to fix on the stern 1R by a supporting member 7 together with covers 9 and 10. A portion of the lower end of the ring-shaped construction 2 is fixed by a supporting member 8 in case of an open stern in FIG. 2, and on the other hand in case of a closed stern in FIG. 3 the lower end is fixed directly to the stern 1R by the notched portion instead of the supporting member.

According to the present invention, in the mounting method of said ring-shaped construction 2 on the ship stern 1R, firstly a plurality of centering pieces are fixed at a predetermined distance on a periphery, more preferably on an inside wall of the ring-shaped construction 2 before fixing it to the ship stern 1R. On these centering pieces, the marking points which are located at an equal distance from the center of the ring-shaped construction 2 are scribed respectively. And there is provided a projector of visible ray which rotates around a rotation axis of the propeller. When the ring-shaped construction equipped with centering pieces are mounted on the stern, the position of the ring-shaped construction is adjusted referring the marked points on centering pieces one by one to the beam of projector by rotating said projector. According to the centering operation applying the projector, a precise mounting of the ring-shaped construction can be attained.

The method for mounting the ring-shaped construction according to the present invention consists of three operation steps, namely a preparatory operation step for the ring-shaped construction on a ground, a preparatory operation step for marking lines on the hull, and a final fitting operation step. Hereunder a detail of the method for mounting the ring-shaped construction on the ship stern is described in a case of an open stern with reference to drawings.

PREPARATORY STEP OF RING-SHAPED CONSTRUCTION

Figure 4:
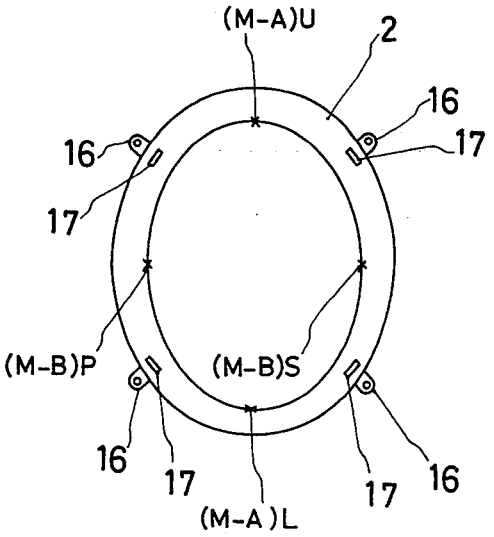
FIG. 4 is a rear view of the ring-shaped construction.
Figure 5:
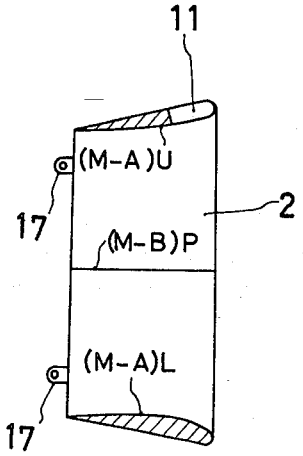
FIG. 5 is a vertical section of the ring-shaped construction shown in FIG. 4.
Figure 6:
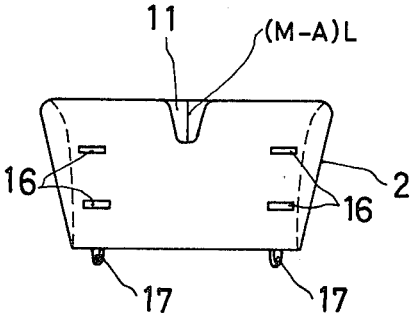
FIG. 6 is a plane view of the ring-shaped construction shown in FIG. 4.

Firstly the ring-shaped construction 2 is designed and manufactured to be conformed with a hull form of a ship. This ring-shaped construction 2 has an elliptical shape as a whole as shown in FIGS. 4, 5 and 6, having a notched portion 11 at the upper end.

As the outer shape of the ring-shaped construction 2 is decided by the required characteristics of the ship, the shape may be selected from a circular form or another form other than an elliptical form.

A diameter of front end side of the ring-shaped construction as a fitting part is formed larger than the diameter of rear side as a free end. The section is a wing shape as a whole, the inside surface forms a convex face, and the outside surface forms a flat face.

Besides the ring-shaped construction, supporting members 7, 8 and covers 9, 10 as auxiliary parts as shown in FIG. 2 are also manufactured. The fabrications of these parts are carried out all on a ground.

On the ring-shaped construction manufactured by the above procedure, the center lines (M-B)P and (M-B)S are marked corresponding to the center of rotation of the propeller 3 at the positions of inside surface of both sides as shown in FIG. 4. Similarly, the center lines (M-A)U and (M-A)L are marked corresponding to the center of rotation of the propeller 3 at the upper and lower positions of the inside surface. The line connecting (M-B)P to (M-B)S and the line connecting (M-A)U to (M-A)L pass respectively through the center of the ring-shaped construction 2.

Figure 7:
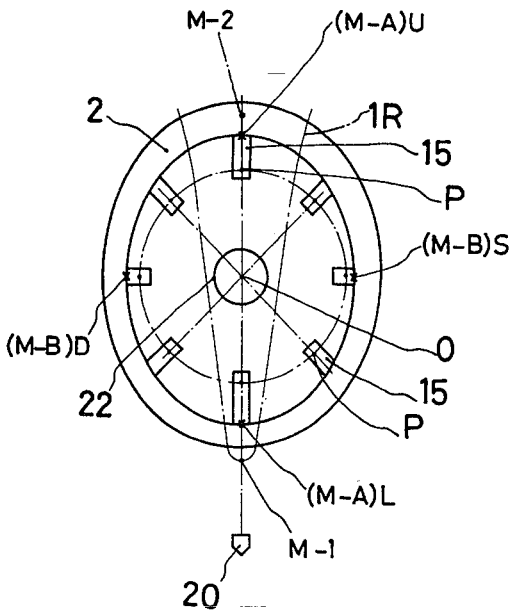
FIG. 7 is an explanatory drawing of a procedure for fixing centering pieces to the ring-shaped construction and marking points on them.

Next, eight pieces of piece 15 as shown in FIG. 7 are manufactured and fixed on an inside surface of the ring-shaped construction 2 with nearly same distances to a radial direction. Marking points P are scribed on these pieces 15 which have the same distance from the center "O" of the ring-shaped construction 2. In this case, the center "O" is coincided with the rotation center of the propeller 3. Marking points P may be scribed on pieces 15 according to a decision in drawings before these pieces 15 are fitted to the ring-shaped construction 2, or marking points P may be scribed after fitting pieces 15 to the ring-shaped construction 2. The number of pieces 15 is not limited to eight, but it may be changed to more or less number at need.

And on the ring-shaped construction 2, a plurality of hanger pieces 16 and 17 are fixed as shown in FIGS. 4, 5 and 6. Hanger pieces 16 are fitted on an outer surface of the ring-shaped construction 2, and hanger pieces 17 are fitted on a rear end portion of the ring-shaped construction 2. These hanger pieces 16 and 17 are used as means for hanging up the ring-shaped construction 2 in a latter fitting step.

PREPARATORY STEP ON A HULL

Figure 8:
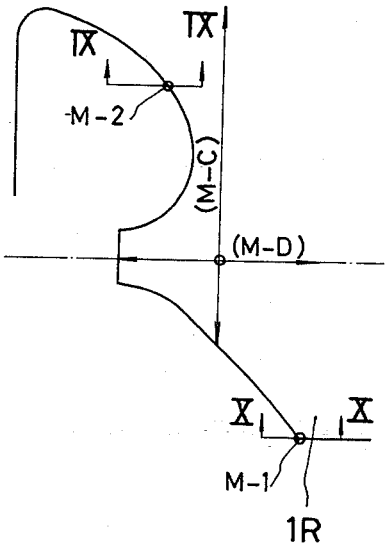
FIG. 8 is an explanatory drawing for showing a condition in which lines are marked on the ship stern.
Figure 9:
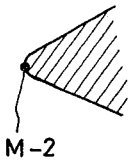
FIG. 9 is a sectional view on the line IX—IX in FIG. 8.
Figure 10:
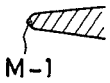
FIG. 10 is a sectional view on the line X—X in FIG. 8.

On a hull side, a marking operation is performed in order to scribe the positions for mounting the ring-shaped construction. At first, as shown in FIG. 8, the front end line (M-C), which corresponds to the front end portion of the ring-shaped construction 2, is marked on both sides of outer plates of the ship stern 1R according to its designing. Next, the center line (M-D), which corresponds to the rotation center of the propeller 3, is marked on a boss of ship stern and both sides of ship stern 1R by using a level gauge. And as shown in FIGS. 8, 9 and 10, the cross point (M-2) is marked where the center line of outer plate of ship stern 1R is intersected with the inside surface of front end portion of the ring-shaped construction 2. Similarly the cross point (M-1) is marked where the center line of outer plate of ship stern 1R is intersected with the keel of hull.

With the above procedure, the preparatory step on the hull is finished.

FITTING OPERATION STEP

In this step, the ring-shaped construction provided with the former preparatory step is fitted on the ship stern provided also with the former preparatory step.

At first, the propeller 3 and the propeller shaft are removed from the ship stern 1R. Next, after carrying the ring-shaped construction 2 on the ground at the rear end of the ship stern 1R, this ring-shaped construction 2 is hung up by winches through wire ropes connected to hanger pieces 16 and 17 to the neighbour of rear portion of boss of propeller shaft at ship stern 1R, and by the following procedures the precise positioning is performed. FIG. 7 shows a positional relationship between the ship stern 1R and the ring-shaped construction in such a positioning operation.

A. Firstly, the front end portion of the ring-shaped construction 2 is coincided with the marked front end line (M-C) on ship stern 1R, where the notched portion 11 of the ring-shaped construction 2 is fitted with the stern.

B. Next, by the fine adjustment of the position of the ring-shaped construction 2 on a vertical direction, the marked point (M-2) on ship stern 1R is coincided with the marked line (M-A)U on the ring-shaped construction 2. At the same time, the point (M-1) on ship stern 1R is located to the position that is extended from the marked line (M-A)L on the ring-shaped construction 2.

C. The rear end of the line (M-A)U is connected to the rear end of the line (M-A)L by a wire hanging a weight 20, and it is confirmed that the point (M-1) is located on the vertical line of the extended wire.

With above procedures, the positioning has been almost finished, but it is still not confirmed whether or not the center of the ring-shaped construction 2 has been coincided completely with the center of rotation of the propeller 3. Therefore such centering operation is performed applying a rotating projector.

Figure 11:
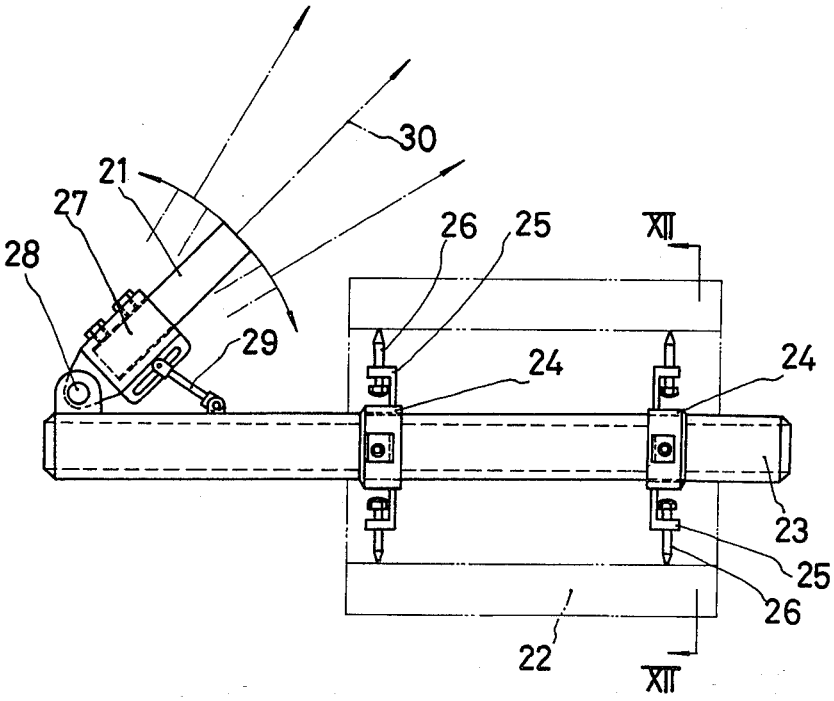
FIG. 11 is a side view showing a device for centering operation.
Figure 12:
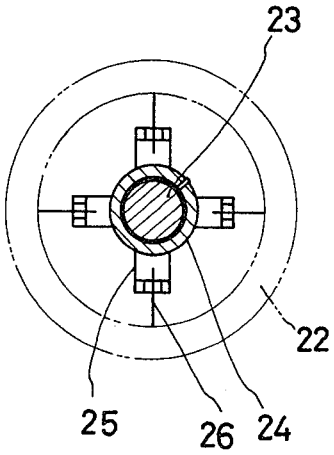
FIG. 12 is a sectional view on the line XII—XII in FIG. 11.

FIGS. 11 and 12 show a centering device, a bearing part 22 being fitted with a propeller shaft, a temporary shaft 23 being inserted to the bearing part 22. The temporary shaft 23 is supported rotatably by rings 24, and a plurality of arms 25 are fixed on the periphery of rings 24 to be extended to a radial direction. Centering bolts 26 are screwed to arms 25, and the top ends of centering bolts 26 are contacted to an inside wall of bearing part 22. Accordingly, by controlling the centering bolts 26, the temporary shaft 23 can be settled to coincide with the center of the bearing part 22. At an end of temporary shaft 23, a holder 27 is mounted oscillatably with the center of a pin 28, and the inclined angle of the holder 27 can be settled by a control bar 29. A projector 21 fixed to the holder 27 can be oscillated together with the holder 27 as one body. Accordingly the direction of a beam 30 emitted from the projector 21 can be set freely. The beam to be emitted from the projector 21 is a visible ray, preferably a laser beam.

Figure 13:
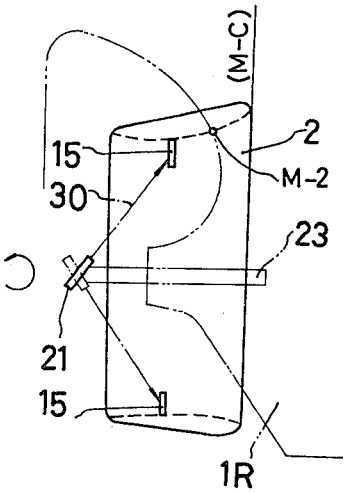
FIG. 13 is an explanatory drawing showing a centering operation applying a projector.
Figure 14:
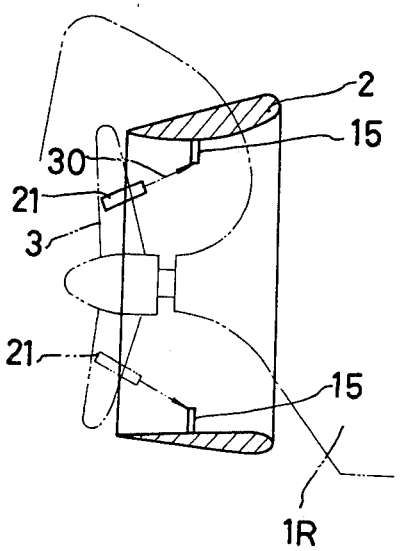
FIG. 14 is an explanatory drawing showing another embodiment of centering operation.

In the said device, when the temporary shaft 23 rotates, the projector 21 is rotated around the rotation center of the propeller 3. Accordingly, as shown in FIG. 13, when the position of the ring-shaped construction 2 is adjusted finely so that the circular locus of the beam passes over the marked points P on a plurality of pieces 15 fixed on the ring-shaped construction 2 by rotating the projector 21, the center of the ring-shaped construction 2 can be completely coincided with the center of rotation of the propeller 3.

When the centering operation is performed as the propeller 3 is mounted to ship stern 1R as it is, the same operation with said mechanism of the temporary shaft can be performed if the projector 21 is fixed to the propeller 3 and rotated together with this propeller 3.

After said position adjustment, the notched portion 11 of the ring-shaped construction 2 is welded to the ship stern. Next, supporting members 7 and 8 are welded temporarily, and then by the centering operation applying the projector 21, a regular welding work is performed. After welding of supporting members 7 and 8, covers 9 and 10 are fixed by welding with same procedure as described before.

After the completion of fitting the ring-shaped construction 2 to the ship stern 1R, the temporary shaft 23 is removed, and the propeller shaft and the propeller 3 are assembled as they were. And then mounting the projector 21 to the propeller 3, the projector 21 rotates, whereby the fitting accuracy is confirmed by reading the difference between the emitted beam and the points P on pieces 15.

After this operation, said projector 21 is removed, and the pieces 15 and the hanger pieces 16 and 17 mounted to the ring-shaped construction 2 are removed. By these procedures, all fitting steps of the ring-shaped construction have been finished.

Figure 15:
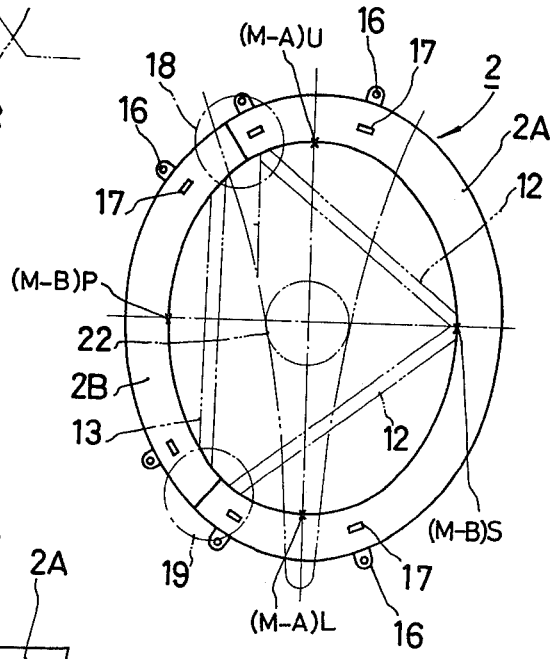
FIG. 15 is a rear view of the ring-shaped construction with a split type.
Figure 16:
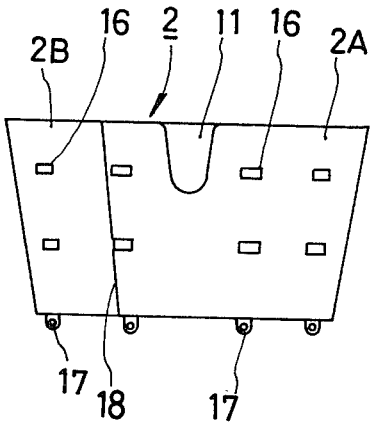
FIG. 16 is a plane view of the ring-shaped construction shown in FIG. 15.

Though the ring-shaped construction described in the above embodied examples consists of one unit construction, the built-up construction of split two members can be applied. The embodied examples shown in FIGS. 15 and 16 show a ring-shaped construction 2 which consists of the combination of the first arc member 2A and the second arc member 2B. In case of fitting the ring-shaped construction on a ship stern in this embodied example, firstly the first arc member 2A is mounted to fix to the stern through the notched portion 11. In this mounting, the temporary supporting member 12 is provided inside of the first arc member 2A. After finishing of mounting this first arc member 2A, the second arc member 2B is connected to be welded at points 18 and 19 to contact the first arc member 2A. In this operation, a temporary supporting member 13 is provided inside of the second arc member 2B. These temporary supporting members 12 and 13 are utilized for preventing the deformations of members 2A and 2B during assembling, and fitting with a high accuracy.

The ring-shaped construction of the split type is convenient in case that a mounting operation is performed in such condition that the propeller 3 is installed to the ship stern because separated members can be mounted to the ship stern independently each other. Namely, it is useful for a simplification of the operation because the troublesome operation for removing and mounting the propeller and the propeller shaft can be omitted.

In the embodied examples, the explanation referred is limited to a case of an open stern, but it can be also practicable in case of a closed stern as well.

As aforementioned, the method for mounting the ring-shaped construction of the present invention provides the mounting said ring-shaped construction on the ship stern with a high accuracy by a very simple operation, since the ring-shaped construction with centering pieces to be fixed inside is manufactured beforehand, and the centering operation applying the circular locus of beam emitted from the rotating projector to the marked points of said pieces is performed.

What is claimed is:

1. A method for mounting a ring shaped member on the stern of a ship, said method comprising:

(a) fixing a plurality of alignment pieces at predetermined positions on a peripheral surface of said ring shaped member;

(b) marking a point on each of said alignment pieces, each point being equidistant from the center of said ring shaped member;

(c) marking lines on said ship's stern indicating the position where said ring shaped member is to be mounted;

(d) provisionally positioning said ring shaped member on said ship's stern with said ring shaped member being aligned with said marking lines thereon;

(e) projecting a circular path centered on the axis of rotation of the propeller of said ship;

(f) aligning said points on said alignment pieces with said projected circular path; and (g) fixing said ring shaped member to said stern.

2. The method of claim 1, wherein the points are marked on said alignment pieces prior to fixing said plurality of alignment pieces on said ring shaped member.

3. The method of claim 1, wherein the points are marked on said alignment pieces after fixing said plurality of alignment pieces on said ring shaped member.

4. The method of any one of claims 1–3, wherein projecting the circular path comprising rotating a beam projecting device about the axis of the ship's propeller.

5. The method of claim 4, wherein said projecting device is a laser beam projector.

6. The method of any one of claims 1–3, including removing said plurality of adjustment pieces from said ring shaped member after said ring shaped member is fixed to said stern.

7. The method of any one of claims 1–3, wherein said alignment members are fixed to the inner peripheral surface of said ring shaped member.

* * * * *